US012611610B1

(12) United States Patent
Chen

(10) Patent No.: US 12,611,610 B1
(45) Date of Patent: Apr. 28, 2026

(54) MAGNETIC BUILDING BLOCK COVER AND MAGNETIC BUILDING BLOCK

(71) Applicant: Yun Chen, Fujian (CN)

(72) Inventor: Yun Chen, Fujian (CN)

( * ) Notice: Subject to any disclaimer, the term of this patent is extended or adjusted under 35 U.S.C. 154(b) by 0 days.

(21) Appl. No.: 19/220,665

(22) Filed: May 28, 2025

(30) Foreign Application Priority Data

Apr. 29, 2025 (CN) ..... 202520837728.3

(51) Int. Cl.
*A63H 33/04* (2006.01)

(52) U.S. Cl.
CPC ..... *A63H 33/046* (2013.01)

(58) Field of Classification Search
CPC ..... A63H 33/26; A63H 33/046
USPC ..... 446/92, 129, 132, 133
See application file for complete search history.

(56) References Cited

U.S. PATENT DOCUMENTS 3,601,921 A * 8/1971 Strohmaier ..... A63H 33/046 446/92
6,024,626 A * 2/2000 Mendelsohn ..... A63H 33/046 446/124
11,045,740 B2 * 6/2021 Wang ..... A63H 33/26
11,103,801 B2 * 8/2021 Vicentelli ..... A63H 33/06
11,207,609 B2 * 12/2021 Rosen ..... A63H 33/046
11,224,821 B2 * 1/2022 Rosen ..... H01F 7/0221
11,406,909 B2 * 8/2022 Zhang ..... A63H 33/26
11,458,410 B2 * 10/2022 Xu ..... A63H 33/046
11,527,344 B2 * 12/2022 Kuo ..... E04B 1/612
11,766,622 B1 * 9/2023 Chen ..... A63H 33/046 446/92
2007/0037469 A1 * 2/2007 Yoon ..... A63H 33/046 446/92
2015/0065007 A1 * 3/2015 Klepper ..... A63H 33/046 446/92
2015/0258462 A1 * 9/2015 Wei ..... A63H 33/06 446/92
2015/0262744 A1 * 9/2015 Wei ..... H01F 7/02 335/306
2018/0056204 A1 * 3/2018 Knudsen ..... A63H 33/046
2019/0201804 A1 * 7/2019 Khalus ..... A63H 33/046
2024/0238688 A1 * 7/2024 Chen ..... A63H 33/046
2024/0238689 A1 * 7/2024 Chen ..... A63H 33/046
2025/0041753 A1 * 2/2025 Chen ..... A63H 33/046
2025/0058243 A1 * 2/2025 Chen ..... A63H 33/046

* cited by examiner

*Primary Examiner* — Joseph B Baldori

(57) ABSTRACT

A magnetic building block cover and a magnetic building block are provided. The magnetic building block includes a magnetic building block cover, a building block body, and magnetic members. The magnetic building block cover includes: a cover body, at least one first enclosure wall, and at least one second enclosure wall. The first enclosure wall and the second enclosure wall form a housing structure. One side of the first enclosure wall is connected to the cover body, and the other side of the first enclosure wall is connected to the second enclosure wall. The housing structure includes at least one first opening, and the first opening is disposed toward a corner of the cover body. The building block body is formed by four sidewalls connected end to end to define two second openings. The magnetic building block cover is configured to cover the second opening.

20 Claims, 5 Drawing Sheets

MAGNETIC BUILDING BLOCK COVER AND MAGNETIC BUILDING BLOCK

CROSS-REFERENCE TO RELATED APPLICATIONS

The application claims priority of Chinese patent application CN202520837728.3, filed on Apr. 29, 2025, which is incorporated herein by reference in its entireties.

TECHNICAL FIELD

The present invention relates to the field of building blocks, and in particular, to a magnetic building block cover and a magnetic building block.

BACKGROUND

Traditional building blocks lack external fixation forces between interconnected blocks, often resulting in misalignment or collapse during construction, which significantly degrades user experience. To address this issue, the present invention provides a magnetic building block cover and a magnetic building block, effectively resolving the aforementioned problems.

SUMMARY

In order to overcome the shortcomings in the prior art, the present invention provides a magnetic building block cover, which includes a cover body, at least one first enclosure wall and at least one second enclosure wall.

The first enclosure wall and the second enclosure wall form a housing structure, one side of the first enclosure wall is connected to the cover body, and the other side of the first enclosure wall is connected to the second enclosure wall; the housing structure includes at least one first opening, and the first opening is oriented toward a corner of the cover body.

Furthermore, the cover body further includes a first recess, and the first recess is disposed opposite to the second enclosure wall.

Furthermore, a thickness of a sidewall at the first recess is less than a thickness of the cover body.

Furthermore, the first enclosure wall includes at least one right angle.

Furthermore, the housing structure is provided in a quantity of four.

Furthermore, the cover body further includes at least one first positioning post; the first positioning post includes a first cylinder and a second cylinder, with one end of the first cylinder connected to the cover body and the other end connected to the second cylinder.

Furthermore, a diameter of the first cylinder is greater than a diameter of the second cylinder.

Furthermore, the first positioning post is provided in a quantity of four.

The present invention also provides a magnetic building block, which includes two magnetic building block covers described above, a building block body, and magnetic members. The building block body is formed by four sidewalls connected end-to-end to define two second openings, each magnetic building block cover is configured to cover one of the second openings, the magnetic members are rotatably disposed in the housing structure, and the housing structure cooperates with two of the sidewalls to retain the magnetic members within the housing structure.

Furthermore, the building block body includes a second recess formed on an inner wall of at least one corner thereof, the second recess being positioned in correspondence with the housing structure.

Furthermore, a thickness of a sidewall at the second recess is less than a thickness of the sidewall.

Furthermore, the second recess is provided in a quantity of four.

Furthermore, the sidewalls include a first sidewall, a second sidewall, a third sidewall, and a fourth sidewall, a first corner is formed between the fourth sidewall and the first sidewall, a second corner is formed between the first sidewall and the second sidewall, a third corner is formed between the second sidewall and the third sidewall, and a fourth corner is formed between the third sidewall and the fourth sidewall.

Furthermore, the housing structure includes a first housing groove, a second housing groove, a third housing groove, and a fourth housing groove, the first housing groove is disposed at the first corner, the second housing groove is disposed at the second corner, the third housing groove is disposed at the third corner, and the fourth housing groove is disposed at the fourth corner.

Furthermore, the building block body further includes at least one second positioning post; the second positioning post includes a positioning hole, and the second cylinder is configured to be inserted into the positioning hole.

Furthermore, the second positioning post is provided in a quantity of four.

Furthermore, the second positioning post is connected to the sidewall.

Furthermore, the building block body further includes a support member connecting the four sidewalls.

Furthermore, the magnetic members include an N-pole and an S-pole.

Furthermore, the magnetic members are eight.

The beneficial effects of the present invention are as follows: The present invention provides a magnetic building block cover and a magnetic building block. Magnetic members are inserted through a first opening into a housing structure disposed on the cover body. The housing structure cooperates with the cover body and the enclosure walls of the building block body to retain the magnetic members within the housing structure to prevent dislodgment. The magnetic members are freely rotatable within the housing structure and includes an N-pole and an S-pole. When two magnetic building blocks are stacked, the magnetic members rotate to align their N-poles and S-poles, causing mutual attraction between the magnetic members of the two blocks. This magnetic interconnection renders the assembled structure resistant to collapse. Furthermore, during assembly of multiple magnetic building blocks, the magnetic members enable precise alignment, eliminating misalignment and significantly enhancing user experience. The magnetic building block further includes a first recess and a second recess. The sidewalls at these recesses have a reduced thickness, thereby enhancing magnetic flux penetration and strengthening the magnetic attraction force. This results in a more stable connection between adjacent magnetic building blocks.

BRIEF DESCRIPTION OF THE DRAWINGS

In order to explain the technical solutions of the embodiments of the present invention more clearly, the following will briefly introduce the accompanying drawings used in the embodiments. Apparently, the drawings in the following description are only some embodiments of the present invention. Those of ordinary skill in the art can obtain other drawings based on these drawings without creative work.

The present invention is further described below in detail in combination with the accompanying drawings and embodiments.

DETAILED DESCRIPTION OF THE EMBODIMENTS

Figure 1:
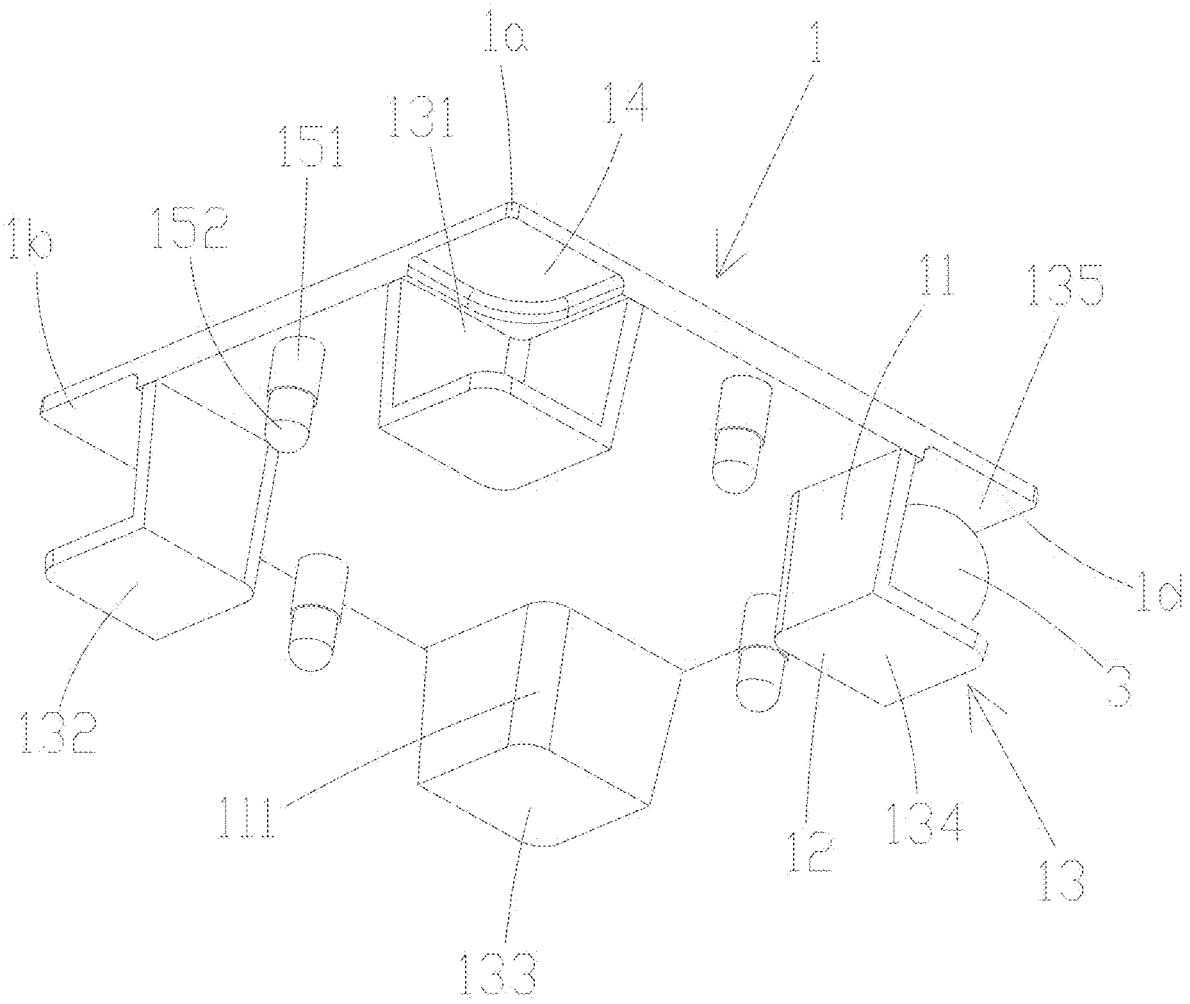
FIG. 1 is a perspective view of the magnetic building block cover according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "a plurality of" means two or more, unless otherwise specifically defined.

The terms "top", "bottom", and other indicating directions or positions are based on the directions or positions shown in the attached drawings in order to facilitate the description of the embodiment and simplify the description of the invention, rather than indicating or implying that the device or element referred to must have a specific orientation, be constructed and operated in a specific orientation, it cannot be understood as a limitation of the embodiment of the invention.

Figure 2:
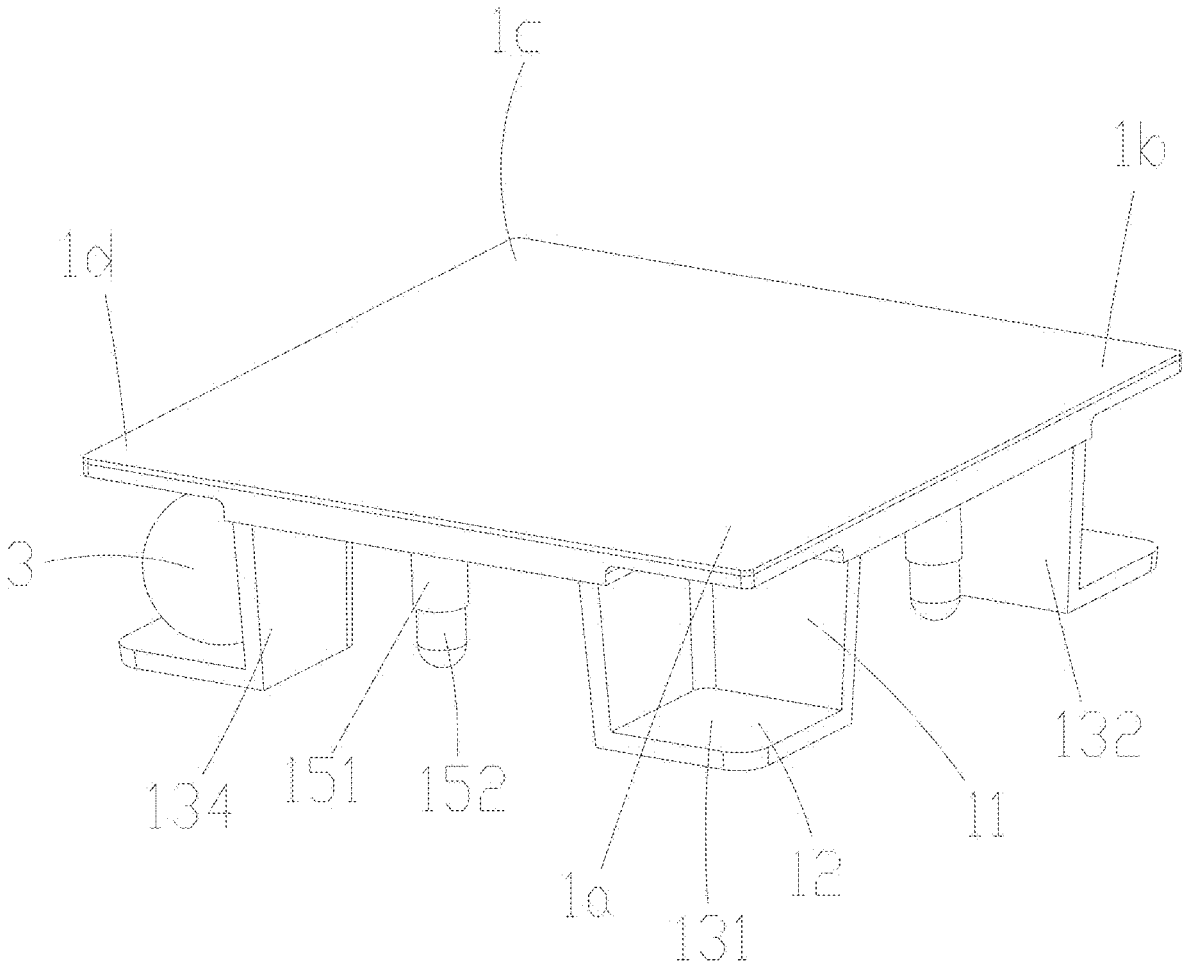
FIG. 2 is a perspective view of the magnetic building block cover from another viewing angle according to the present invention.

Referring to FIGS. 1 and 2, the present invention provides a magnetic building block cover including: a cover body 1, at least one first enclosure wall 11, and at least one second enclosure wall 12.

The first enclosure wall 11 and the second enclosure wall 12 form a housing structure 13, with one side of the first enclosure wall 11 connected to the cover body 1 and the other side of the first enclosure wall 11 connected to the second enclosure wall 12. The housing structure 13 includes at least one first opening 135, and the first opening 135 is oriented toward a corner of the cover body 1.

Through the above structural arrangement, the first enclosure wall 11 and the second enclosure wall 12 are connected to form a housing structure 13. One end of the first enclosure wall 11 is connected to the cover body 1, and the other end of the first enclosure wall 11 is connected to the second enclosure wall 12. The second enclosure wall 12 is disposed opposite to the cover body 1, and the first opening 135 is oriented toward a corner of the cover body 1. During the production and assembly of the product, the magnetic members 3 may be inserted into the housing structure 13 through the first opening 135, thereby mounting the magnetic members 3 on the magnetic building block cover. This design is simple and ingenious, which can reduce the material usage of the building block body 2, save costs, and reduce weight, thereby enhancing the user experience during use.

In this embodiment, the first enclosure wall 11 includes one right angle 111. This configuration facilitates mold fabrication for production and enhances convenience during both production and assembly processes.

In this embodiment, the cover body 1 further includes a first recess 14 disposed opposite to the second enclosure wall 12. The first recess 14 is formed by an inward depression at a corner of the inner wall of the cover body 1. The number of first recesses 14 is four. Through the above structural arrangement, the housing structure 13 can obtain a larger space, enabling the magnetic members 3 to rotate more smoothly within the housing structure 13. Additionally, this configuration allows for material savings and further weight reduction. The thickness of the cover body 1 at the first recesses 14 is thinner, thereby enhancing the magnetic penetration of the magnetic members 3. This results in a stronger magnetic attraction between the magnetic members 3 of the assembled magnetic building blocks, further ensuring a more secure adsorption connection between the magnetic building blocks.

In this embodiment, the number of the housing structures 13 is four. The housing structure 13 includes a first housing groove 131, a second housing groove 132, a third housing groove 133, and a fourth housing groove 134. The magnetic building block includes a first corner 1*a*, a second corner 1*b*, a third corner 1*c*, and a fourth corner 1*d*. The first housing groove 131 is disposed at the first corner 1*a*, the second housing groove 132 is disposed at the second corner 1*b*, the third housing groove 133 is disposed at the third corner 1*c*, and the fourth housing groove 134 is disposed at the fourth corner 1*d*. With the housing structures 13 disposed at the four corners and the magnetic members 3 disposed in the first housing groove 131, the second housing groove 132, the third housing groove 133, and the fourth housing groove 134, each corner of the magnetic building block can be provided with magnetic force, enabling the magnetic force range of the magnetic members 3 to cover a wider area. Consequently, the stability of the mutual adsorption connection during the assembly of the magnetic building blocks is increased.

In this embodiment, the cover body 1 further includes at least one first positioning post disposed on the inner wall of the cover body 1. The first positioning post includes a first cylinder 151 and a second cylinder 152, and the diameter of the first cylinder 151 is larger than that of the second cylinder 152. One end of the first cylinder 151 is connected to the cover body 1, and the other end is connected to the second cylinder 152. The building block body 2 includes at least one second positioning post 24, which includes a positioning hole 241. The size of the positioning hole 241 is matched with that of the second cylinder 152, and the second cylinder 152 is configured to be inserted into the positioning hole 241. After the second cylinder 152 is inserted into the positioning hole 241, the second cylinder 152 slides relative to the positioning hole 241 until the first cylinder 151 abuts against the second positioning post 24, so that the first positioning post and the second positioning post 24 are accurately docked to complete the assembly, ensuring that the magnetic building block cover can assemble in the correct position.

In this embodiment, the number of the first positioning posts and the second positioning posts 24 is four each. The four first positioning posts are used in cooperation with the four second positioning posts 24, which can make the connection between the cover body 1 and the building block body 2 more stable.

Figure 3:
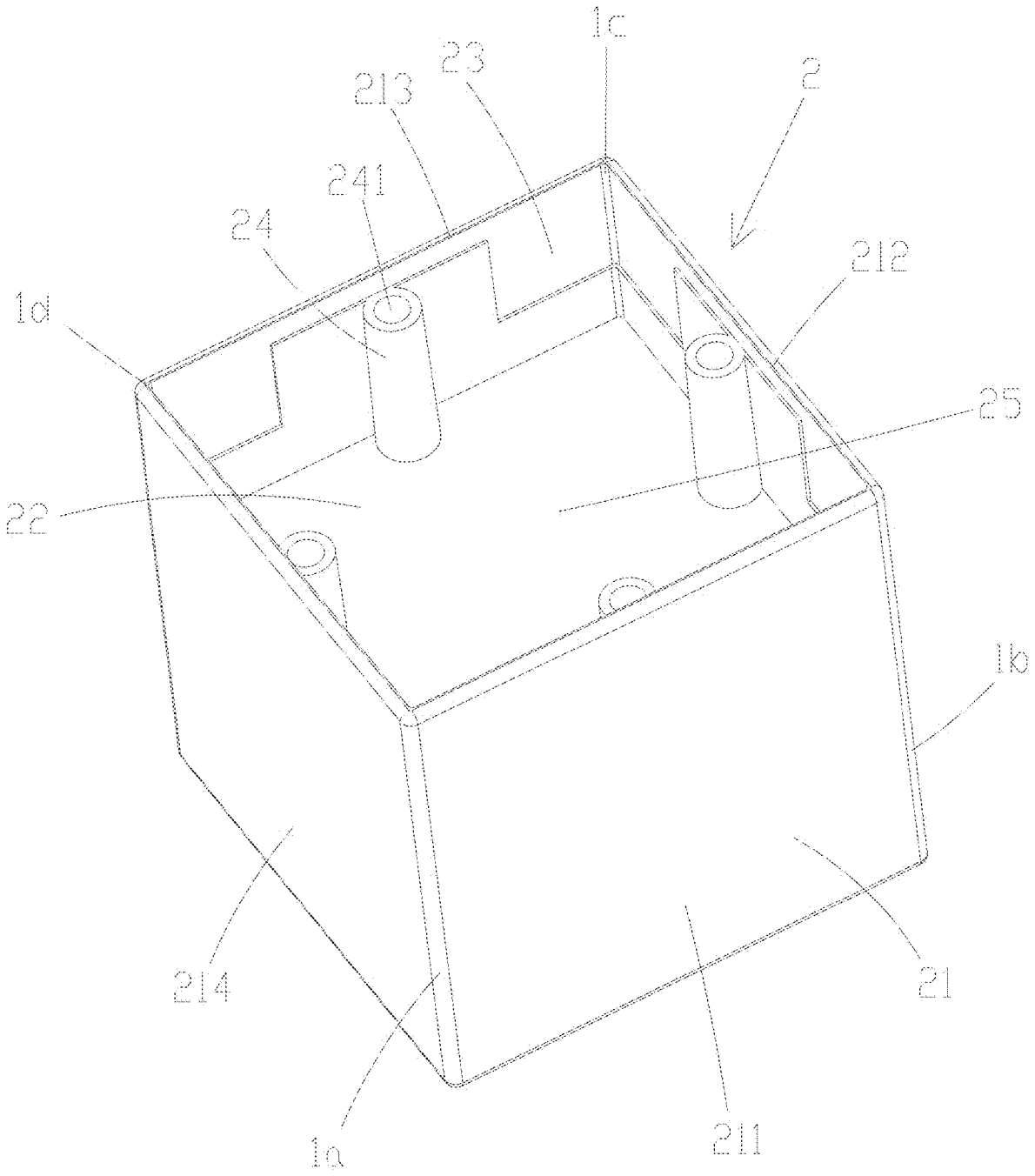
FIG. 3 is a perspective view of the building block body of the magnetic building block according to the present invention.
Figure 4:
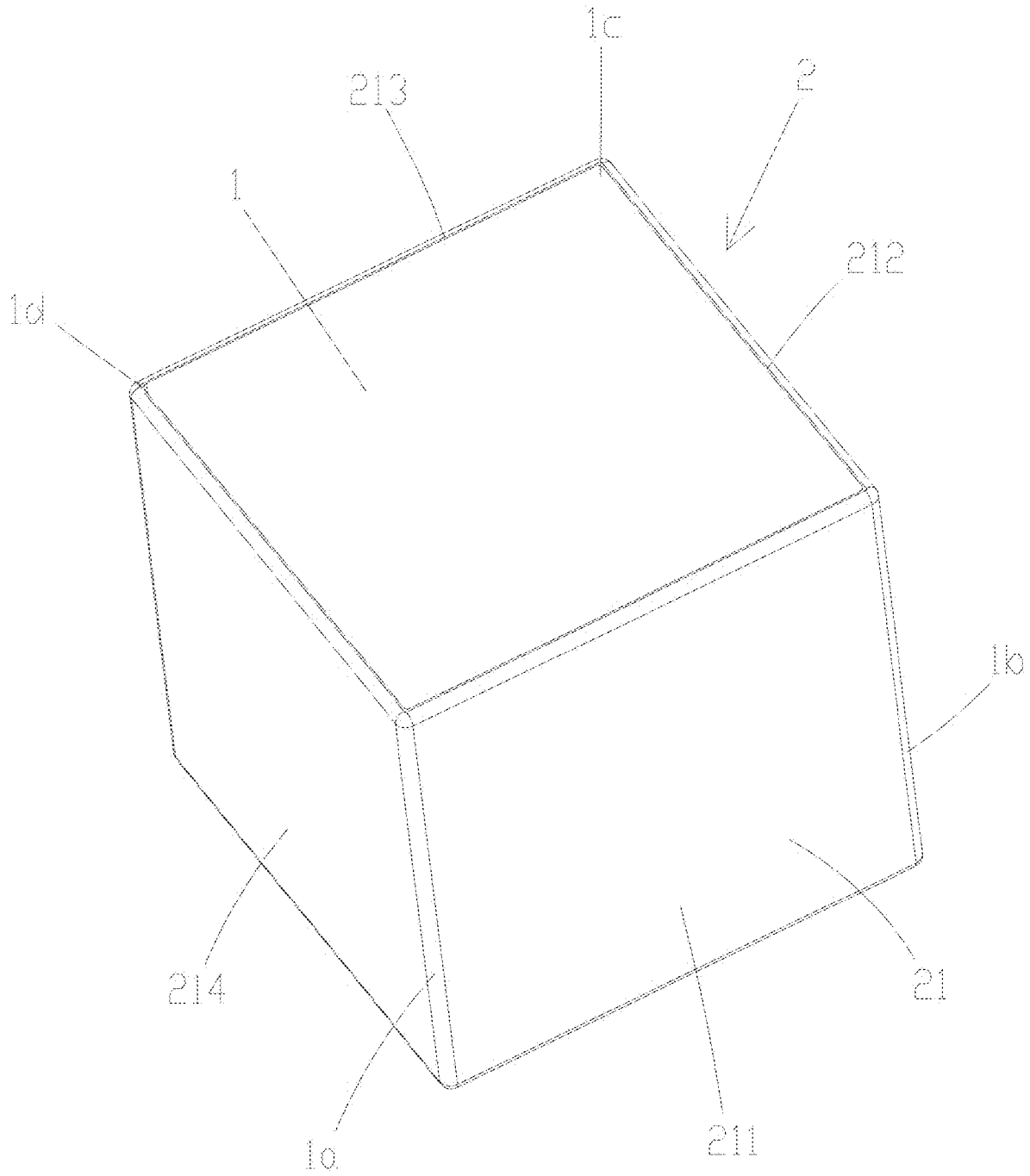
FIG. 4 is a perspective view of the magnetic building block according to the present invention.
Figure 5:
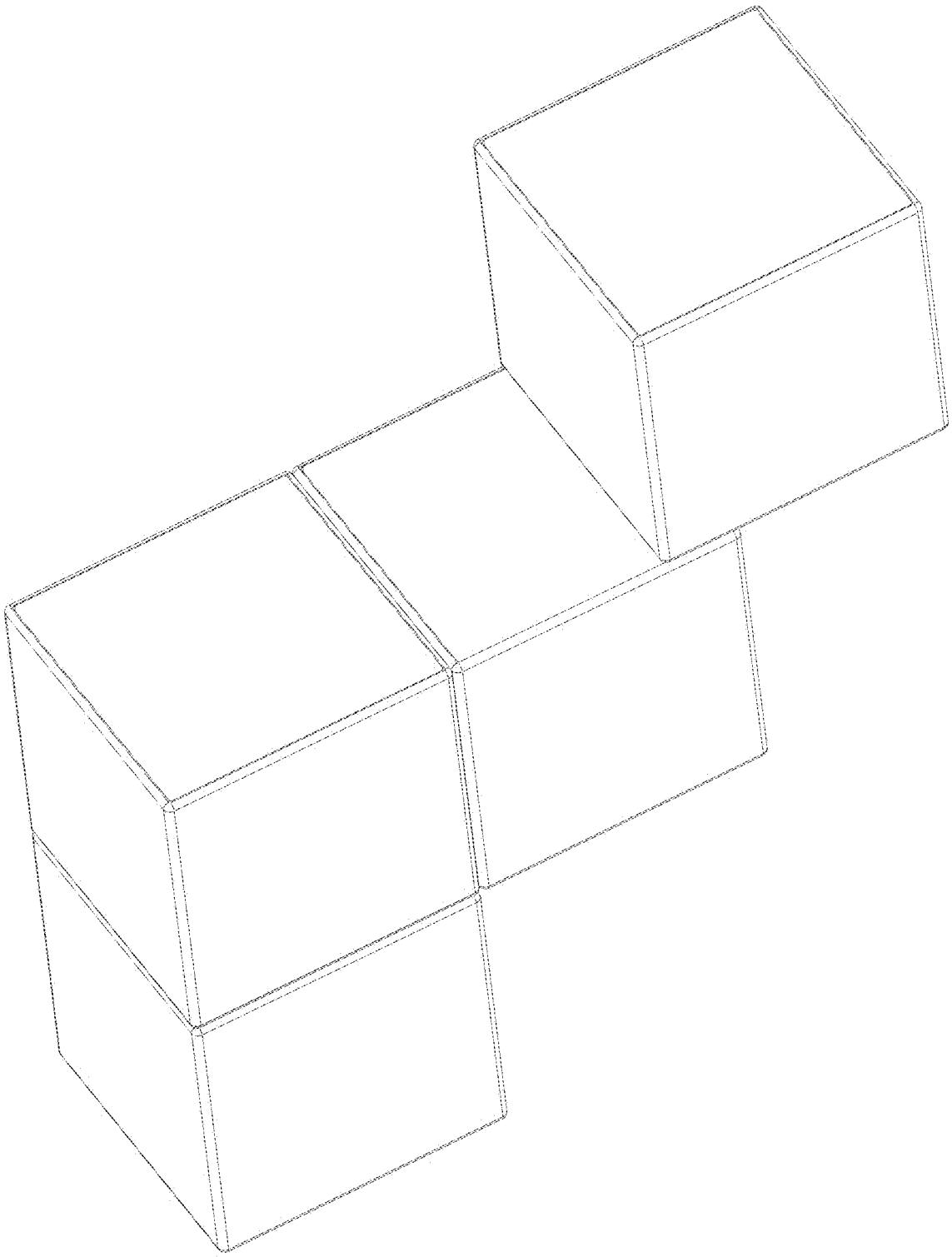
FIG. 5 is a schematic diagram of the magnetic building block in an operational state according to the present invention.

Referring to FIGS. 3 to 5, the present invention further provides a magnetic building block, including: a magnetic building block cover, a building block body 2, and magnetic members 3. The building block body 2 is formed by four sidewalls 21 connected end to end to define two second openings 22. Two magnetic building block covers are respectively configured to cover the two second openings 22. The second cylinder 152 is inserted into the positioning hole 241 to securely mount the magnetic building block cover on the building block body 2. The magnetic members 3 is disposed in the housing structure 13 and is freely rotatable. Two sidewalls 21 of the building block body 2 cooperatively seal the first opening 135 of the housing structure 13, preventing the magnetic members 3 from falling out of the housing structure 13. The structural design is simple and ingenious, saving space and materials.

In this embodiment, a second recess 23 is provided on the inner wall of the corner of the building block body 2. The second recess 23 is formed by inwardly recessing the inner walls of two adjacent sidewalls 21, and the position of the second recess 23 corresponds to the position of the housing structure 13. Through the above structural arrangement, the second recess 23 provides a larger rotation space for the magnetic members 3, allows for material savings, and further reduces the overall weight. The thickness of the sidewall 21 at the second recess 23 is relatively thinner, thereby enhancing the magnetic penetration of the magnetic members 3 therein. This results in a stronger magnetic attraction between the magnetic members 3 of the assembled magnetic building blocks, further ensuring a more secure adsorption connection between the magnetic building blocks.

In this embodiment, the sidewalls 21 include a first sidewall 211, a second sidewall 212, a third sidewall 213, and a fourth sidewall 214. One end of the first sidewall 211 is connected to the second sidewall 212, and the other end is connected to the fourth sidewall 214. One end of the second sidewall 212 is connected to the first sidewall 211, and the other end is connected to the third sidewall 213. One end of the third sidewall 213 is connected to the second sidewall 212, and the other end is connected to the fourth sidewall 214. One end of the fourth sidewall 214 is connected to the first sidewall 211, and the other end is connected to the third sidewall 213. A second corner 1*b* is formed between the first sidewall 211 and the second sidewall 212, a third corner 1*c* is formed between the second sidewall 212 and the third sidewall 213, a fourth corner 1*d* is formed between the third sidewall 213 and the fourth sidewall 214, and a first corner 1*a* is formed between the fourth sidewall 214 and the first sidewall 211. The first housing groove 131 cooperates with the first sidewall 211 and the fourth sidewall 214 to retain the magnetic members 3 within the first housing groove 131. The second housing groove 132 cooperates with the first sidewall 211 and the second sidewall 212 to retain the magnetic members 3 within the second housing groove 132. The third housing groove 133 cooperates with the second sidewall 212 and the third sidewall 213 to retain the magnetic members 3 within the third housing groove 133. The fourth housing groove 134 cooperates with the third sidewall 213 and the fourth sidewall 214 to retain the magnetic members 3 within the fourth housing groove 134.

In this embodiment, the building block body 2 includes a support member 25 disposed inside, and the support member 25 is connected to the first sidewall 211, the second sidewall 212, the third sidewall 213, and the fourth sidewall 214, respectively. Through the above structural arrangement, the support member 25 can support the first sidewall 211, the second sidewall 212, the third sidewall 213, and the fourth sidewall 214, such that the first sidewall 211, the second sidewall 212, the third sidewall 213, and the fourth sidewall 214 are not easily deformed when subjected to external pressure, thereby enhancing the strength of the building block body 2 and improving the compression resistance and drop resistance of the product. Preferably, the support member 25 may have a hollow structure, which can reduce the overall weight while providing support, thus achieving both increased strength and lightweight characteristics for the magnetic building block.

In this embodiment, the second positioning post 24 is connected to the sidewall 21, and the second positioning post 24 is integrally formed with the sidewall 21. Through the above structural arrangement, the connection between the second positioning post 24 and the sidewall 21 can increase the strength of the sidewall 21, thereby further enhancing the strength of the building block body 2. The integral formation of the second positioning post 24 and the sidewall 21 during production can save production time and simultaneously increase the connection strength between the second positioning post 24 and the sidewall 21.

In this embodiment, the magnetic members 3 are magnets, and the number of the magnetic members 3 is eight. Each magnetic member 3 includes an N pole and an S pole. When two or more magnetic building blocks are brought close to each other, the magnetic members 3 disposed in the housing structures 13 rotate and adjust the orientations of their N and S poles in advance due to magnetic forces. Finally, the magnetic members 3 in one magnetic building block is adjusted to present an N pole or an S pole, while the magnetic members 3 in another magnetic building block is adjusted to present an S pole or an N pole, such that the N and S poles face each other to achieve mutual attraction. Consequently, the two magnetic building blocks are magnetically attracted and connected to each other, making them difficult to separate, thereby improving the user experience during assembly. Moreover, the eight magnetic members 3 are all disposed at each corner of the magnetic building block, facilitating precise alignment between building blocks and preventing skewing. Additionally, the wider magnetic force coverage of the magnetic members 3 allows the edges or corners of adjacent magnetic building blocks to magnetically connect, enabling users to explore more assembly methods and enhancing the interactivity and enjoyment of the magnetic building blocks.

As described above, one or more embodiments are provided in conjunction with the detailed description, The specific implementation of the present invention is not confirmed to be limited to that the description is similar to or similar to the method, the structure and the like of the present invention, or a plurality of technical deductions or substitutions are made on the premise of the conception of the present invention to be regarded as the protection of the present invention.

What is claimed is:

1. A magnetic building block cover, comprising:

a cover body;

at least one first enclosure wall; and at least one second enclosure wall, wherein the first enclosure wall and the second enclosure wall form a housing structure, one side of the first enclosure wall is connected to the cover body, and the other side of the first enclosure wall is connected to the second enclosure wall; the housing structure comprises at least one first opening enclosed by a part of the cover body, an outward surface of the first enclosure wall, and the second enclosure wall, and the first opening is oriented toward a corner of the cover body; the second enclosure wall is entirely positioned on the outward surface of the first enclosure wall.

2. The magnetic building block cover according to claim 1, wherein the cover body further comprises a first recess, and the first recess is disposed opposite to the second enclosure wall.

3. The magnetic building block cover according to claim 2, wherein a thickness of a sidewall at the first recess is less than a thickness of the cover body.

4. The magnetic building block cover according to claim 1, wherein the first enclosure wall comprises at least one right angle.

5. The magnetic building block cover according to claim 1, wherein the housing structure is provided in a quantity of four.

6. The magnetic building block cover according to claim 1, wherein the cover body further comprises at least one first positioning post: the first positioning post comprises a first cylinder and a second cylinder, with one end of the first cylinder connected to the cover body and the other end connected to the second cylinder.

7. The magnetic building block cover according to claim 6, wherein a diameter of the first cylinder is greater than a diameter of the second cylinder.

8. The magnetic building block cover according to claim 6, wherein the first positioning post is provided in a quantity of four.

9. A magnetic building block comprising:

two magnetic building block covers according to claim 1, a building block body, and magnetic members;

wherein the building block body is formed by four sidewalls connected end-to-end to define two second openings, each magnetic building block cover is configured to cover one of the second openings, the magnetic members are rotatably disposed in the housing structure, and the housing structure cooperates with two of the sidewalls to retain the magnetic members within the housing structure.

10. The magnetic building block according to claim 9, wherein the building block body comprises a second recess formed on an inner wall of at least one corner thereof, the second recess being positioned in correspondence with the housing structure.

11. The magnetic building block according to claim 10, wherein a thickness of a sidewall at the second recess is less than a thickness of the sidewall.

12. The magnetic building block according to claim 10, wherein the second recess is provided in a quantity of four.

13. The magnetic building block according to claim 9, wherein the sidewalls comprise a first sidewall, a second sidewall, a third sidewall, and a fourth sidewall, a first corner is formed between the fourth sidewall and the first sidewall, a second corner is formed between the first sidewall and the second sidewall, a third corner is formed between the second sidewall and the third sidewall, and a fourth corner is formed between the third sidewall and the fourth sidewall.

14. The magnetic building block according to claim 13, wherein the housing structure comprises a first housing structure, a second housing structure, a third housing structure, and a fourth housing structure, the first housing structure is disposed at the first corner, the second housing structure is disposed at the second corner, the third housing structure is disposed at the third corner, and the fourth housing structure is disposed at the fourth corner.

15. The magnetic building block according to claim 9, wherein the building block body further comprises at least one second positioning post; the second positioning post comprises a positioning hole, and the second cylinder is configured to be inserted into the positioning hole.

16. The magnetic building block according to claim 15, wherein the second positioning post is provided in a quantity of four.

17. The magnetic building block according to claim 15, wherein the second positioning post is connected to the sidewall.

18. The magnetic building block according to claim 9, wherein the building block body further comprises a support member connecting the four sidewalls.

19. The magnetic building block according to claim 9, wherein the magnetic members are eight.

20. The magnetic building block cover according to claim 1, wherein the first opening opens outwards between the cover body and the second enclosure wall and along two directions which are perpendicular to each other.

* * * * *